US009757969B2

(12) United States Patent
Udo et al.

(10) Patent No.: US 9,757,969 B2
(45) Date of Patent: Sep. 12, 2017

(54) APPARATUS AND METHOD FOR FORMING AN IMAGE WITH A NON-DECOLORIZABLE MATERIAL AND A DECOLORIZABLE MATERIAL

(71) Applicant: Toshiba Tec Kabushiki Kaisha, Tokyo (JP)

(72) Inventors: Motonari Udo, Shizuoka-ken (JP); Masahiro Ikuta, Shizuoka-ken (JP); Kazuhisa Takeda, Shizuoka-ken (JP); Tsuyoshi Itou, Shizuoka-ken (JP); Takayasu Aoki, Shizuoka-ken (JP); Takafumi Hara, Shizuoka-ken (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/365,055

(22) Filed: Nov. 30, 2016

(65) Prior Publication Data

US 2017/0080737 A1 Mar. 23, 2017

Related U.S. Application Data

(63) Continuation of application No. 15/044,328, filed on Feb. 16, 2016, now Pat. No. 9,539,843, which is a continuation of application No. 14/133,388, filed on Dec. 18, 2013, now Pat. No. 9,291,950.

(51) Int. Cl.

| | |
|---|---|
| ***G03G 15/01*** | (2006.01) |
| ***B41M 7/00*** | (2006.01) |
| ***G03G 15/16*** | (2006.01) |
| ***G03G 15/00*** | (2006.01) |

(52) U.S. Cl.

CPC ..... *B41M 7/0009* (2013.01); *B41M 7/009* (2013.01); *G03G 15/16* (2013.01); *G03G 15/6585* (2013.01)

(58) Field of Classification Search

CPC ..... G03G 15/16; G03G 15/0121; G03G 15/6585; G03G 21/00; G03G 21/0064; G03G 9/09; G03G 9/0926; G03G 2215/209; G03G 2221/1642; B41M 7/0009

USPC ..... 399/297–299, 407, 409; 347/179; 358/1.13; 430/125.3

See application file for complete search history.

(56) References Cited

U.S. PATENT DOCUMENTS

| | | | | |
|---|---|---|---|---|
| 5,400,123 | A | 3/1995 | Sato et al. | |
| 7,945,189 | B2 | 5/2011 | Yamashita | |
| 8,754,915 | B2 * | 6/2014 | Umetsu | B41J 11/0015 347/179 |
| 8,953,965 | B2 * | 2/2015 | Kaneko | B41J 29/38 399/69 |
| 9,291,950 | B2 | 3/2016 | Udo et al. | |
| 2012/0141154 | A1 | 6/2012 | Yoshida | |
| 2012/0327481 | A1 | 12/2012 | Yamauchi | |
| 2013/0011777 | A1 | 1/2013 | Aoki et al. | |

(Continued)

*Primary Examiner* — Hoan Tran

(74) *Attorney, Agent, or Firm* — Foley & Lardner LLP

(57) ABSTRACT

An image forming apparatus includes a first image forming unit configured to form a first image to be transferred to a sheet with a non-decolorizable material, and a second image forming unit configured to form a second image to be transferred to the sheet with a decolorizable material. At least a part of the second image transferred to the sheet is formed on the first image transferred to the sheet.

12 Claims, 3 Drawing Sheets

(56) References Cited

U.S. PATENT DOCUMENTS

2013/0063748 A1* 3/2013 Mimura ..... H04N 1/00411
358/1.13

* cited by examiner

APPARATUS AND METHOD FOR FORMING AN IMAGE WITH A NON-DECOLORIZABLE MATERIAL AND A DECOLORIZABLE MATERIAL

CROSS-REFERENCE TO RELATED APPLICATION

This application is a Continuation of U.S. application Ser. No. 15/044,328, filed Feb. 16, 2016, incorporated herein by reference in its entirety, which is a Continuation of U.S. application Ser. No. 14/133,388, filed Dec. 18, 2013, (now U.S. Pat. No. 9,291,950), incorporated herein by reference in its entirety.

FIELD

Embodiments described herein relate to image forming with a decolorizable material such as a decolorizable toner that can be decolorized by heat.

BACKGROUND

There is an image forming apparatus that form an image on a sheet with decolorizable material. When the image formed on the sheet with the decolorizable material is subjected to an erasing process by heating the sheet to a certain temperature, the image is erased and the sheet can be reused for printing. Thus, the same sheet can be repetitively used. In addition, a conventional image forming apparatus that forms an image on a sheet with a non-decolorizable material is known. When it is desired to form the image of the decolorizable material and the image of the non-decolorizable material on a single sheet, these images are formed separately on the sheet.

DETAILED DESCRIPTION

In general, according to one embodiment, an image forming apparatus includes a first image forming unit configured to form a first image to be transferred to a sheet with a non-decolorizable material, and a second image forming unit configured to form a second image to be transferred to the sheet with a decolorizable material. At least a part of the second image transferred to the sheet is formed on the first image transferred to the sheet.

Figure 1:
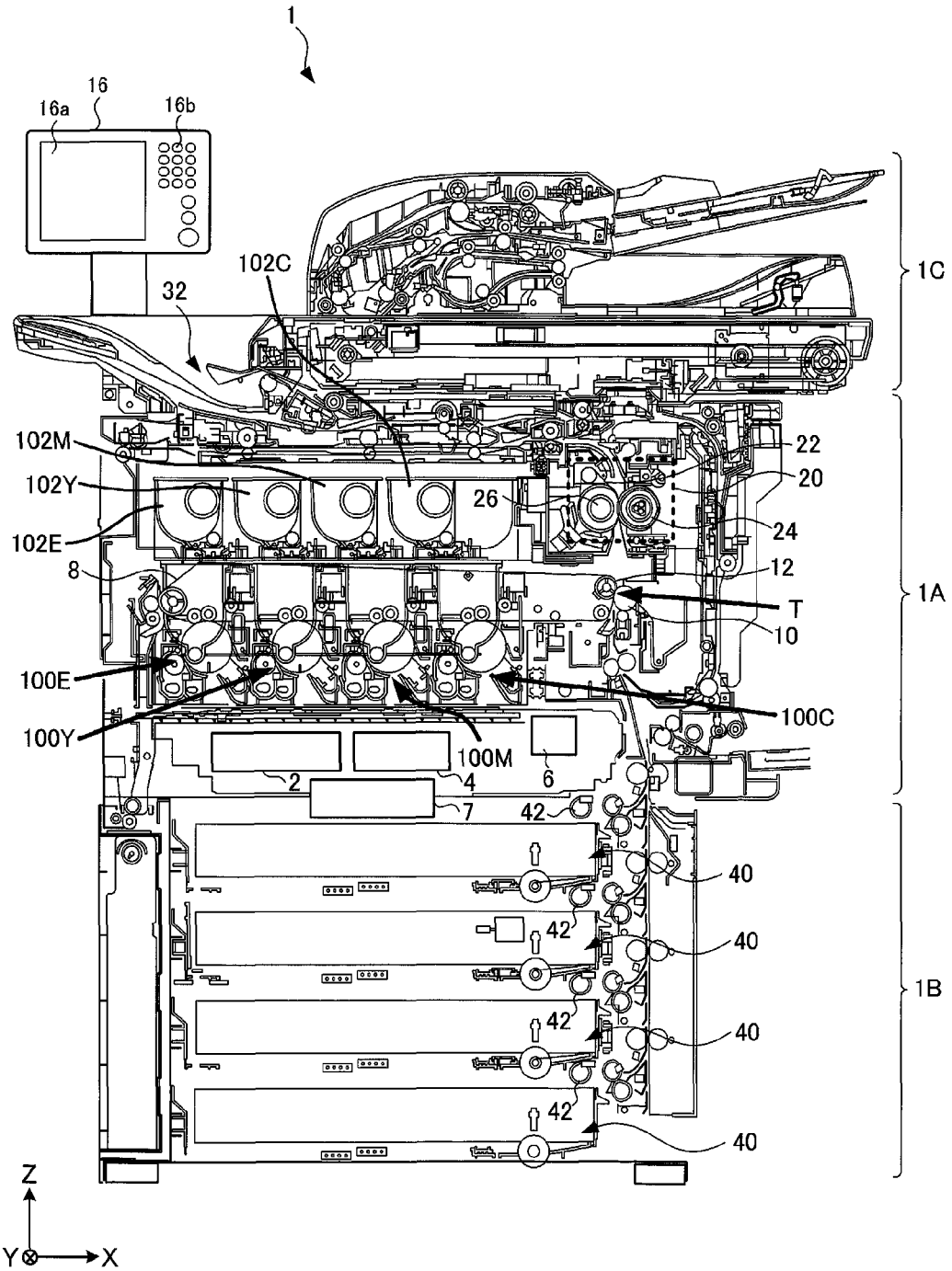
FIG. 1 is a longitudinal sectional diagram schematically showing a configuration of an image forming apparatus according to an embodiment.

First, an image forming apparatus according to an embodiment will be described. FIG. 1 is a longitudinal sectional diagram schematically showing a configuration of an image forming apparatus 1 according to the embodiment. The image forming apparatus 1 is, for example, a multi-functional peripheral (MFP) apparatus having a plurality of functions such as a print function, a copy function of scanning and printing a manuscript, and a scan function. The image forming apparatus 1 according to this embodiment uses both decolorizable toner as a decolorizable recording material which is decolorized at a decolorizing temperature or higher, and normal toner (non-decolorizable toner) as a non-decolorizable recording material which cannot be decolorized, and can form an image with any one or a combination of the toners. Herein, normal electrophotographic toner, which is not decolorizable, is referred to as non-decolorizable toner. In this embodiment, a case in which toners are used as a decolorizable recording material and a non-decolorizable recording material will be described. However, the recording material may be an ink, ink ribbon for thermal transfer, or the like.

The image forming apparatus 1 includes a processor 2, a memory 4, an auxiliary storage device 6, an operating panel 16, an image forming portion 1A, a sheet supply portion 1B, an image reading portion 1C, and the like.

The processor 2 is a control device which controls various processes carried out at the image forming portion 1A, the sheet supply portion 1B, and the image reading portion 1C. The processor 2 performs various functions and executes processes by executing programs stored in the memory 4 and the auxiliary storage device 6.

A central processing unit (CPU), a micro-processing unit (MPU) capable of executing the same arithmetic processing as that of the CPU, or the like is used as the processor 2. In addition, an application specific integrated circuit (ASIC) 7 as a processor may perform some or all of the functions of the image forming apparatus 1, which are performed by the processor 2.

The memory 4 is a so-called main storage device which stores programs for enabling the processor 2 to execute processes such as an image forming process in the image forming portion 1A, a sheet supply process in the sheet supply portion 1B, and an image reading process in the image reading portion 1C. The memory 4 provides a temporary working area to the processor 2. For example, a random access memory (RAM), a read only memory (ROM), a dynamic random access memory (DRAM), a static random access memory (SRAM), a video RAM (VRAM), a flash memory, or the like is used as the memory 4.

The auxiliary storage device 6 stores various kinds of information related to the image forming apparatus 1. For example, the auxiliary storage device 6 can store image data generated based on a surface of a sheet read in the image reading portion 1C. For example, a magnetic storage device such as a hard disk drive, an optical storage device, a semiconductor storage device (flash memory or the like), or a combination of the storage devices is used as the auxiliary storage device 6.

The operating panel 16 is a unit to input operational instruction by a user to the image forming apparatus 1, and is also a display portion which displays a setting screen and the like. The operating panel includes a touch display 16*a*, operating keys 16*b*, and the like. The touch display 16*a* displays a screen and the user can perform operational input with the screen. The operating keys 16*b* are physical buttons with which the user can perform various operational inputs.

During printing or copying, the image forming portion 1A performs a process of forming an image on a sheet. The image forming portion 1A forms an image on a sheet such as paper supplied from the sheet supply portion 1B on the basis of print job or copy job. The image forming portion 1A of this embodiment can form an image on paper with one or both of normal toner and decolorizable toner, which is decolorized by heat.

The image forming portion 1A includes processing units, toner cartridges, an intermediate transfer belt 8 as an image carrier, a secondary transfer roller 10 which is a transfer member, a secondary transfer opposing roller 12, a fixing device 20 which is a fixing portion, and the like.

Each processing unit forms a toner image on the intermediate transfer belt 8 with corresponding toner. The image forming apparatus 1 of this embodiment has four processing units (100E, 100Y, 100M, and 100C) as the processing units. The processing unit 100E forms an image with decolorizable toner. The processing unit 100Y forms an image with normal yellow toner. The processing unit 100M forms an image with normal magenta toner. The processing unit 100C forms an image with normal cyan toner.

In this embodiment, the processing units 100E, 100Y, 100M, and 100C are arranged in this order along the intermediate transfer belt 8 from the upstream side toward the downstream side in a moving direction of the intermediate transfer belt 8 with respect to a secondary transfer position T at which a toner image is transferred to paper.

Each of the processing units 100E to 100C includes a photosensitive drum, a developing machine, a primary transfer roller which is disposed at a position opposed to the photosensitive drum with the intermediate transfer belt 8 interposed therebetween, and the like.

The toner cartridges are filled with color toners, respectively. The toner cartridge supplies the toner to the developing machine of the processing unit corresponding to the toner. The image forming apparatus 1 of this embodiment includes a toner cartridge 102E corresponding to the decolorizable toner, a toner cartridge 102Y corresponding to the normal yellow toner, a toner cartridge 102M corresponding to the normal magenta toner, and a toner cartridge 102C corresponding to the normal cyan toner. The color-erasable toner of this embodiment will be described in detail.

The intermediate transfer belt 8 is an image carrier to which a toner image of toner formed on the photosensitive drum corresponding to each toner is transferred (primarily transferred) from the photosensitive drum. The intermediate transfer belt 8 transfers the formed toner image to a recording medium such as paper at the secondary transfer position T. At the secondary transfer position T, the secondary transfer roller 10 nips the paper with the secondary transfer opposing roller 12 opposed thereto, and transfers the toner image on the intermediate transfer belt 8 to the paper.

The fixing device 20 fixes, to the paper, the developer image transferred to the paper by heating and pressing. The fixing device 20 includes a fixing belt 22, a fixing roller 26, a pressing roller 24, and the like.

Figure 2A:
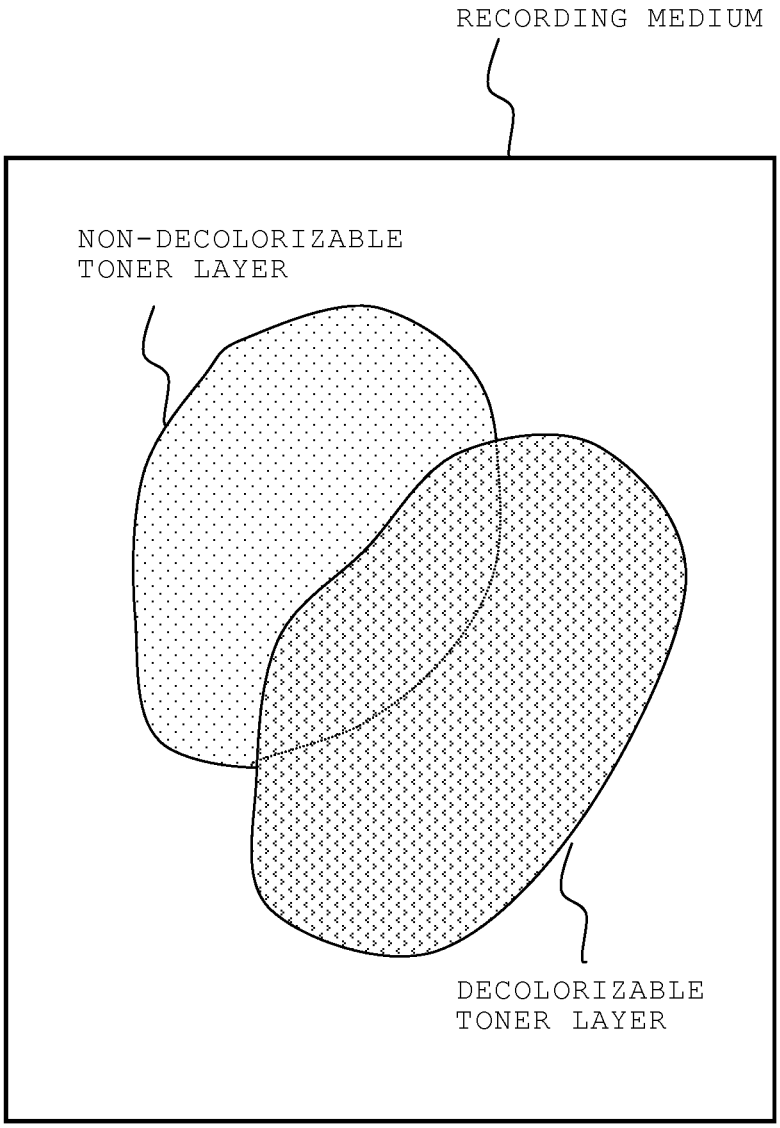
FIG. 2A is a plan diagram schematically showing a layer structure of a sheet and toner layers formed thereon by the image forming apparatus according to the embodiment.
Figure 2B:
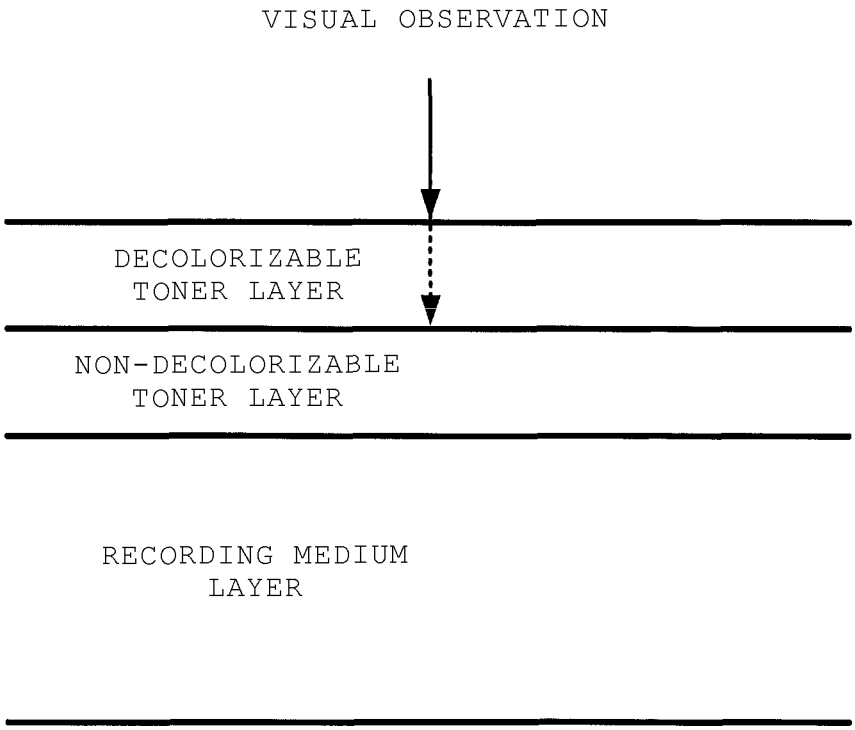
FIG. 2B is a cross sectional diagram schematically showing a layer structure of a sheet and toner layers formed thereon by the image forming apparatus according to the embodiment.

The image forming portion 1A is configured as described above. When an image is formed with the decolorizable toner image overlapping the normal toner image by the above image forming portion 1A, first, the decolorizable toner image and the normal toner image are formed on the intermediate transfer belt 8 in this order. The toner image of the decolorizable toner image and the normal toner image is secondarily transferred from the intermediate transfer belt 8 to paper, and the toner image is fixed onto the paper by the fixing device 20. Thus, the normal toner image and the color-erasable toner image are formed in this order on the paper as shown in FIG. 2A and FIG. 2B.

The sheet supply portion 1B supplies sheets, which are recording media, to the image forming portion 1A. The sheet supply portion 1B includes a paper feeding cassette 40, a pickup roller 42, a plurality of pairs of transport rollers which transport sheets toward the secondary transfer position T, and the like. FIG. 1 shows an image forming apparatus including, for example, four paper feeding cassettes 40.

The image reading portion 1C is a device which reads an image on a sheet when performing copying or scanning, and is an image reading device of a copier, an image scanner, or the like.

Next, the decolorizable toner used in the image forming apparatus 1 of this embodiment will be described. The image forming apparatus 1 of this embodiment uses decolorizable toner and normal toner. As described above, among the plurality of processing units, the processing unit 100E corresponding to the decolorizable toner is disposed upstream in the moving direction of the intermediate transfer belt 8 with respect to the other processing units. Therefore, when the decolorizable toner image and the normal toner image are superimposed with each other to form an image, the image is formed such that the decolorizable toner image is superimposed on the normal toner image on paper.

The decolorizable toner image is superimposed on the normal toner image, and thus the normal toner image can be hidden, that is, masked. As the decolorizable toner image masks the image thereunder, the image is hidden when the decolorizable toner image is in a color-developed state. However, when the decolorizable toner image is erased by heating to a decolorizing temperature or higher, as shown by the broken line arrow of FIG. 2B, the image thereunder is visible through the decolorized toner image.

Regarding the decolorizable toner of this embodiment, a density of a color material in the decolorizable toner is preferably larger than a density of a color material in the normal toner which forms a target image to be masked by the decolorizable toner image. When the density of the color material in the decolorizable toner is larger, the image formed with the normal toner under the decolorizable toner image can be more reliably masked. Here, in the decolorizable toner, the "color material" includes a coloring agent and a color developing agent. When a decolorizing temperature control agent is contained in the decolorizing toner, the color material also contains the decolorizing temperature control agent. The color material of the normal non-decolorizable toner includes a pigment.

In addition, when the decolorizable toner image masks the image formed with the normal toner, a decolorizable toner having a similar color to that of the masking target image is preferably used for the masking. When an image is formed with the toners having similar colors, the decolorizable toner and the image of the normal toner are not easily distinguished, and thus more reliable masking can be performed.

In addition, the color material of the decolorizable toner of this embodiment is preferably contained in a proportion of 3% to 30% in the total weight of the toner. When the proportion is less than 3%, the decolorizable toner has a too faint color, and thus the masking effect is not easily obtained. When the proportion is greater than 30%, the decolorizable toner is not easily fixed onto paper.

A configuration of the decolorizable toner of this embodiment will be described. The decolorizable toner contains an electron-donating coloring agent, an electron-accepting color developing agent, and a binder resin. The decolorizable toner may further contain a decolorizing temperature control agent, a release agent, a reactive polymer, an electrification control agent, an aggregating agent, a surfactant, a pH adjuster, an external additive, and the like.

The electron-donating coloring agent is a precursor compound of a pigment which depicts letters, figures, and the like. A leuco dye can be mainly used as the electron-donating coloring agent. The leuco dye is an electron-donating compound which can develop a color with a color developing agent. Examples of the leuco dye include diphenylmethanephthalides, phenylindolylphthalides, indolylphthalides, diphenylmethaneazaphthalides, phenylindolylazaphthalides, fluorans, styrynoquinolines, and diazarhodamine lactones.

Specific examples of the leuco dye include 3,3-bis(p-dimethylaminophenyl)-6-dimethylamino phthalide, 3-(4-diethylaminophenyl)-3-(1-ethyl-2-methylindole-3-yl)phthalide, 3,3-bis(1-n-butyl-2-methylindole-3-yl)phthalide, 3,3-bis(2-ethoxy-4-diethylaminophenyl)-4-azaphthalide, 3-(2-ethoxy-4-diethylaminophenyl)-3-(1-ethyl-2-methylindole-3-yl)-4-azaphthalide, 3-[2-ethoxy-4-(N-ethylanilino)phenyl]-3-(1-ethyl-2-meth ylindole-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N, N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H)isobenzofuran]-3'-one, 2-(diethylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-methyl-, spiro[5H-(1)benzopyrano(2,3-d)pyrimidine-5,1'(3'H)isobenzofuran]-3'-one, 2-di-n-butylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindole-3-yl)-4,5,6,7-tetrachlorophthalide, 3-(2-ethoxy-4-diethylaminophenyl)-3-(1-ethyl-2-methylindole-3-yl)-4,5,6,7-tetrachlorophthalide, and 3-(2-ethoxy-4-diethylaminophenyl)-3-(1-pentyl-2-methylindole-3-yl)-4,5,6,7-tetrachlorophthalide. Pyridine, quinazoline, and bisquinazoline compounds may also be included. These may be used as a mixture of two or more.

The electron-accepting color developing agent is a color developing agent which allows the coloring agent to develop color, and is an electron-accepting compound which donates a proton to the leuco dye. Examples of the electron-accepting color developing agent include phenols, phenol metal salts, carboxylic acid metal salts, aromatic carboxylic acids, aliphatic carboxylic acids having 2 to 5 carbon atoms, benzophenones, sulfonic acids, sulfonates, phosphoric acids, phosphoric acid metal salts, acidic phosphoric acid esters, acidic phosphoric acid ester metal salts, phosphorous acids, phosphorous acid metal salts, monophenols, polyphenols, 1, 2, 3-triazole and derivatives thereof, either unsubstituted or substituted with substituents such as an alkyl group, an aryl group, an acyl group, an alkoxycarbonyl group, a carboxy group and an ester thereof, an amide group, and a halogen group. In addition, bis- and tris-phenols, phenol-aldehyde condensation resins, and metal salts thereof may also be included.

Specific examples of the electron-accepting color developing agent include phenol, o-cresol, tertiary butylcatechol, nonylphenol, n-octylphenol, n-dodecylphenol, n-stearylphenol, p-chlorophenol, p-bromophenol, o-phenylphenol, n-butyl p-hydroxybenzoate, n-octyl p-hydroxybenzoate, benzyl p-hydroxybenzoate, dihydroxybenzoic acids such as 2,3-dihydroxybenzoic acid and methyl 3,5-dihydroxybenzoate and esters thereof, resorcin, gallic acid, dodecyl gallate, ethyl gallate, butyl gallate, propyl gallate, 2,2-bis(4-hydroxyphenyl)propane, 4,4-dihydroxydiphenylsulfone, 1,1-bis(4-hydroxyphenyl)ethane, 2,2-bis(4-hydroxy-3-methylphenyl)propane, bis(4-hydroxyphenyl) sulfide, 1-phenyl-1,1-bis(4-hydroxyphenyl)ethane, 1,1-bis(4-hydroxyphenyl)-3-methylbutane, 1,1-bis(4-hydroxyphenyl)-2-methylpropane, 1,1-bis(4-hydroxyphenyl)n-hexane, 1,1-bis(4-hydroxyphenyl)n-heptane, 1,1-bis(4-hydroxyphenyl)n-octane, 1,1-bis(4-hydroxyphenyl)n-nonane, 1,1-bis(4-hydroxyphenyl)n-decane, 1,1-bis(4-hydroxyphenyl)n-dodecane, 2,2-bis(4-hydroxyphenyl)butane, 2,2-bis(4-hydroxyphenyl)ethylpropionate, 2,2-bis(4-hydroxyphenyl)-4-methylpentane, 2,2-bis(4-hydroxyphenyl)hexafluoropropane, 2,2-bis(4-hydroxyphenyl)n-heptane, 2,2-bis(4-hydroxyphenyl)n-nonane, 2,4-dihydroxyacetophenone, 2,5-dihydroxyacetophenone, 2,6-dihydroxyacetophenone, 3,5-dihydroxyacetophenone, 2,3,4-trihydroxyacetophenone, 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, 2,3,4,4'-tetrahydroxybenzophenone, 2,4'-biphenol, 4,4'-biphenol, 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl)methyl]-1,2,3-benzenetriol, 4,4'-[1,4-phenylenebis(1-methylethylidene)bis(benzene-1,2,3-triol)], 4,4'-[1,4-phenylenebis(1-methylethylidene)bis(1,2-benzenediol)], 4,4',4"-ethylidenetrisphenol, 4,4'-(1-methylethylidene)bisphenol, and methylenetris-p-cresol. These may be used as a mixture of two or more.

The binder resin is melted in the fixing process and fixes, to the paper, the coloring agent which is a color material and the color developing agent. A polyester resin which is obtained by subjecting a dicarboxylic acid component and a diol component to polycondensation through an esterification reaction is preferable as the binder resin. When a styrene resin is used as the binder resin, fixing needs a higher temperature because the glass transition temperature of the styrene resin is generally higher than that of the polyester resin. Examples of the acid component include aromatic dicarboxylic acids such as terephthalic acid, phthalic acid, and isophthalic acid, and aliphatic carboxylic acids such as fumaric acid, maleic acid, succinic acid, adipic acid, sebacic acid, glutaric acid, pimelic acid, oxalic acid, malonic acid, citraconic acid, and itaconic acid.

Examples of the alcohol component (diol component) include aliphatic diols such as ethylene glycol, propylene glycol, 1,4-butanediol, 1,3-butanediol, 1,5-pentanediol, 1,6-hexanediol, neopentyl glycol, trimethylene glycol, trimethylolpropane and pentaerythritol, alicyclic diols such as 1,4-cyclohexanediol and 1,4-cyclohexanedimethanol, and ethylene oxide or propylene oxide adducts of bisphenol A or the like.

As the binder resin, the polyester component may be converted to have a crosslinked structure using a tri- or higher-valent carboxylic acid component such as 1,2,4-benzenetricarboxylic acid (trimellitic acid) and glycerin or a polyhydric alcohol component. Two or more types of polyester resins having different compositions may be mixed and used.

The polyester resin which is the binder resin may be amorphous or crystalline. The glass transition temperature of the polyester resin is preferably 45° C. to 70° C., and more preferably 50° C. to 65° C. It is preferable that the glass transition temperature be higher than 35° C., because the heat-resistant storage stability of the toner deteriorates and the gloss of the resin is significant upon erasing. It is preferable that the glass transition temperature be lower than 70° C., because the low-temperature fixability deteriorates and the erasability upon heating is poorer.

By including the decolorizing temperature control agent a decolorizing temperature can be adjusted. The decolorizing temperature control agent enables the decolorizing by inhibiting a color developing reaction between the leuco dye as a coloring agent and the color developing agent under heat in the three-component system of the coloring agent (coloring compound), the color developing agent, and the decolorizing temperature control agent.

Including the decolorizing temperature control agent is particularly preferable, because the color developing-decolorizing mechanism, based on temperature hysteresis, of the decolorizing temperature control agent leads to excellent instantaneous erasability. It is possible to cause decolorizing when heating the color-developed mixture of the three-component system to a specific decolorizing temperature Th or higher. Furthermore, even when the decolorized mixture is cooled to a temperature equal to or lower than Th (approximately room temperature), the decolorized state is maintained. When the temperature is further lowered, a reversible color developing-decolorizing reaction can be caused, in which the color developing reaction between the leuco dye and the color developing agent is restored at a temperature equal to or lower than a specific color restoring temperature Tc to return to the color-developed state. Particularly, the decolorizing temperature control agent used herein preferably satisfies a relation of Th>Tr>Tc, where Tr represents a room temperature.

Preferable examples of the decolorizing temperature control agent capable of causing the temperature hysteresis include alcohols, esters, ketones, ethers, and acid amides. Particularly, esters are more preferable. Specific examples of the esters include carboxylic acid esters that contain a substituted aromatic ring, esters of unsubstituted aromatic ring-containing carboxylic acid and aliphatic alcohol, carboxylic acid esters that contain a cyclohexyl group in the molecule, esters of fatty acid and unsubstituted aromatic alcohol or phenol, esters of fatty acid and branched aliphatic alcohol, esters of dicarboxylic acid and aromatic alcohol or branched aliphatic alcohol, dibenzyl cinnamate, heptyl stearate, didecyl adipate, dilauryl adipate, dimyristyl adipate, dicetyl adipate, distearyl adipate, trilaurin, trimyristin, tristearin, dimyristin, and distearin. These may be used as a mixture of two or more.

The release agent improves releasability from the fixing member when the toner is fixed to paper by heating or pressing. Examples of the release agent include aliphatic hydrocarbon waxes such as low-molecular weight polyethylene, low-molecular weight polypropylene, polyolefin copolymers, polyolefin wax, paraffin wax, and Fischer Tropsch wax and modified products thereof, vegetable waxes such as candelilla wax, carnauba wax, Japan wax, jojoba wax, and rice wax, animal waxes such as beeswax, lanolin, and spermaceti, mineral waxes such as montan wax, ozokerite, and ceresine, fatty acid amides such as linolenic acid amide, oleic acid amide, lauric acid amide, functional synthetic waxes, and silicone waxes.

Here, it is particularly preferable that the release agent have an ester bond of components including an alcohol component and a carboxylic acid component. Examples of the alcohol component include higher alcohols, and examples of the carboxylic acid component include saturated fatty acids having a linear alkyl group, unsaturated fatty acids such as monoenoic acid and polyenic acid, and hydroxy fatty acids. As an unsaturated polycarboxylic acid, maleic acid, fumaric acid, citraconic acid, itaconic acid, or the like can be exemplified. Anhydrides thereof may be exemplified. The softening point of the release agent is preferably approximately 50° C. to 120° C., and more preferably 60° C. to 110° C. from the viewpoint of low-temperature fixability.

The reactive polymer is, for example, a polymer capable of crosslinking the binder resin. Examples of the reactive polymer include reactive polymers having an oxazoline group. The reactive polymer is preferably water-soluble in order to manufacture the decolorizable toner of this embodiment in an aqueous system. Examples of preferable commercialized products thereof include "EPOCROS WS-500" and "EPOCROS WS-700", manufactured by Nippon Shokubai Co., Ltd.

As other reactive polymers, there are compounds having an epoxy group, and examples of commercialized products thereof include DENACOL EX313, 314, 421, 512, and 521, manufactured by Nagase ChemteX Corporation. These compounds having an epoxy group may be used alone when the binder resin is a resin having a carboxyl group (oxidized polyester or polystyrene resin). A substance having an amino group or a hydroxyl group may be added as the reactive polymer.

Using a crosslinking agent of such a reactive polymer, color material fine particles can be completely incorporated in the toner, and thus the image density during printing is improved and image defects such as fogging are improved.

By including the electrification control agent, a frictional electrification charge amount can be adjusted. A metal-containing azo compound can be used as the electrification control agent, and a complex, complex salt, or a mixture of iron, cobalt and chrome is preferable as a metal element. In addition, the electrification control agent may be a metal-containing salicylic acid derivative compound. A complex, complex salt, or a mixture of zirconium, zinc, chrome, and boron is preferable as a metal element of the metal-containing salicylic acid derivative compound.

In this embodiment, an aggregating agent may be used as necessary. The aggregating agent is not particularly limited, and a monovalent metal salt such as sodium chloride, a polyvalent metal salt such as magnesium sulfate or aluminum sulfate, a non-metal salt such as ammonium chloride or ammonium sulfate, an acid such as hydrochloric acid or nitric acid, or a strong cationic coagulant (aggregating agent) based on polyamine or polyDADMAC may be appropriately used as the aggregating agent.

In this embodiment, a surfactant may be used as necessary. The surfactant is not particularly limited, and, for example, an anionic surfactant based on sulfuric ester salt, sulfonate, phosphoric acid ester, or fatty acid salt, a cationic surfactant based on amine salt or quarternary ammonium salt, an ampholytic surfactant based on betaine, a nonionic surfactant based on polyethylene glycol, alkylphenol ethylene oxide adduct, or polyhydric alcohol, or a polymeric surfactant based on polycarboxylic acid can be appropriately used as the surfactant. In general, the surfactant is added for the purpose of imparting dispersion stability such as stability of aggregated particles when a toner is manufactured. However, a reverse-polarity surfactant or the like may be used as the aggregating agent.

In this embodiment, a pH adjuster for adjusting the pH in the system may be used as necessary. The pH adjuster is not particularly limited. For example, as an alkali, a basic compound such as sodium hydroxide, potassium hydroxide, or an amine compound, and as an acid, an acidic compound such as hydrochloric acid, nitric acid, or sulfuric acid can be appropriately used.

In this embodiment, inorganic fine particles as an external additive may be mixed with the toner in an amount of 0.01 wt % to 20 wt % with respect to toner particles in order to adjust fluidity and electrification properties. As the inorganic fine particles which are used as an external additive, silica, titania, alumina, strontium titanate, tin oxide, and the like can be used alone or as a mixture of two or more. It is preferable to use inorganic fine particles surface-treated with a hydrophobizing agent from the viewpoint of an improvement in environmental stability. Other than such an inorganic oxide, resin particles having a diameter of 1 μm or less may be added as an external additive for improving cleanability.

The color developing mechanism of the decolorizable toner containing the above components has a characteristic that the coloring agent based on a leuco dye represented by crystal violet lactone (CVL) develops a color when the color developing agent represented by a phenolic compound is combined, and is decolorized when being dissociated therefrom. When a substance, called the decolorizing temperature control agent, having a large difference between a melting point and a solidifying point is used as well as the coloring agent and the color developing agent, a color material which is decolorized when being heated to a temperature equal to or higher than the melting point of the decolorizing temperature control agent and in which the color-erased state is maintained even at room temperature when the solidifying point is equal to or lower than the room temperature is obtained. It is possible to use a color-developable and decolorizable color material system in which the leuco coloring agent, the color developing agent, and the decolorizing temperature control agent are encapsulated.

In general, in order to fix the toner, the fixing temperature of the decolorizable toner is required to be higher than a glass transition temperature Tg of the binder resin and be at least adjacent to a softening temperature Tm. In addition, in the present system, the fixing temperature is required to be equal to or lower than the decolorizing temperature Th in order not to erase the color during fixing.

In addition, the electron-donating coloring agent, the electron-accepting color developing agent, and the decolorizing temperature control agent of the decolorizable toner are preferably microencapsulated as the color material. The foregoing materials are rarely affected by external environment through the microencapsulation, and thus it is possible to more accurately control the color developing and the decolorizing.

Next, a method of manufacturing the toner used in this embodiment will be described. Regarding the decolorizable toner of this embodiment, particulates of a toner component are preferably manufactured by a so-called chemical manufacturing method and aggregated by an aggregating method to have a particle diameter required for the toner. In general, it is preferable that the toner be manufactured by a method other than a kneading method, because decolorizing occurs during kneading at the kneading temperature, which is generally higher than the decolorizing temperature of the color material.

In the chemical manufacturing method, after aggregation of toner particles, a fusion process is performed to smooth a surface of a toner particle and to increase a toner circularity. In general, the fusion temperature is equal to or higher than the glass transition temperature Tg of the resin. Accordingly, when the decolorizing temperature of the color material is lower than the fusion temperature, decolorizing occurs during the fusion process. Accordingly, the decolorizing temperature of the color material is preferably higher than the fusion temperature.

An example of a flow of a method of manufacturing the decolorizable toner will be described. First, a color material containing a coloring agent, a color developing agent, and a decolorizing temperature control agent is melted by heating. The color material is microencapsulated using a urethane resin through a coacervation method. Next, the microencapsulated color material, a binder resin dispersion liquid in which a binder resin is dispersed, and a release agent dispersion liquid in which a release agent is dispersed are aggregated and fused using an aggregating agent (for example, aluminum sulfate ($Al_2$ $(SO_4)_3$)). The resulting material is washed and dried to obtain a toner.

The decolorizable toner of each color is manufactured using different types of decolorizing temperature control agents in order that the decolorizing temperature varies for each color.

For microencapsulation of the color material, a method using an isocyanate polyol wall material, a method using a urea-formaldehyde or urea-formaldehyde-resorcinol-based wall forming material, or a method using a wall forming material such as a melamine-formaldehyde resin or hydroxypropyl cellulose is used. The method for encapsulation is not limited to an a coacervation method, and a method by polymer precipitation, an in-situ method by monomer polymerization, an electrolysis-dispersion-cooling method, a spray drying method, and the like may also be used.

The configuration of the image forming apparatus 1 and the configuration of the decolorizable toner used in the image forming apparatus 1 of this embodiment are as described above. The normal non-decolorizable toner contained in the image forming apparatus 1 is not particularly limited, and an electrophotographic toner which is used in an image forming apparatus of the related art may be used.

[Image Forming Method]

Next, an image forming method of forming an image in which the decolorizable toner masks an image of the normal toner will be described as an image forming method in the image forming apparatus 1. The image forming portion 1A of the image forming apparatus 1 forms an image on the basis of print job or copy job. When an acquired print job or the like is a job instructing to form an image with the decolorizable toner to thus superimpose the image on an image formed with the normal toner, the image forming portion 1A forms an image on the basis of the job to superimpose the decolorizable toner. Actually, first, the processing unit 100E corresponding to the decolorizable toner transfers an image to the intermediate transfer belt 8. Thus, when the image is formed on a part designated to form the image with the decolorizable toner, the image of the decolorizable toner is formed on the image of the normal toner on the paper.

The image forming apparatus 1 can preferably form an image with decolorizable toner of at least one color and normal non-decolorizable toner of at least one color. Specifically, at least one processing unit corresponding to the decolorizable toner and at least one processing unit corresponding to the non-decolorizable toner may be provided. In addition, the image forming apparatus 1 may further include, as a processing unit corresponding to non-decolorizable toner, a processing unit corresponding to black which forms a toner image with black toner. When the processing unit corresponding to black is provided, it is preferably disposed downstream side with respect to the other processing units in the belt rotating direction of the intermediate transfer belt 8.

Examples

Next, examples in which an image is formed by superimposing a decolorizable toner on an image formed with a normal toner will be described in detail. First, preparation of the decolorizable toner and the normal toner will be described.

(Preparation of Decolorizable Toner)

<Preparation of Dispersion of Decolorizable Toner Color-Developed Particles C>

Components including 1 part of 3-(2-ethoxy-4-diethylaminophenyl)-3-(1-ethyl-2-methylindole-3-yl)-4-azaphthalide as a leuco dye as a coloring agent, 5 parts of 2,2-bis(4-hydroxyphenyl)hexafluoropropane as a color developing agent, and 50 parts of a diester compound of pimelic acid and 2-(4-benzyloxyphenyl)ethanol as a decolorizing temperature control agent were dissolved by heating and were mixed with 20 parts of an aromatic polyvalent isocyanate prepolymer and 40 parts of ethyl acetate as encapsulating agents to obtain a solution. The solution was poured to 250 parts of an aqueous solution of 8% polyvinyl alcohol, and emulsified and dispersed. Stirring of the resulting dispersion was continued for about 1 hour at 90° C. Then, 2 parts of water-soluble aliphatic modified amine as a reaction agent was added thereto and the stirring was further continued for about 3 hours while maintaining the liquid temperature to 90° C. to obtain colorless encapsulated particles. Furthermore, the encapsulated particle dispersion was put into a freezer to develop a color, thereby obtaining a dispersion of color-developed particles C having a blue color. The volume average particle diameter of the color-developed particles C measured by SALD7000 manufactured by Shimadzu Corporation was 2 μm.

<Preparation of Dispersion of Decolorizable Toner Component Particles R>

94 parts of a polyester resin (glass transition temperature: 45° C., softening point: 100° C.) as a binder resin, 5 parts of rice wax as a release agent, and 1 part of an electrification control agent (TN-105) manufactured by Hodogaya Chemical Co., Ltd. as an electrification control agent were uniformly mixed with a dry mixer, and then melted and kneaded at 80 degrees with a twin-screw kneader PCM-45 manufactured Ikegai Corporation. The obtained toner composition was pulverized by passing through a 2-mm mesh by a pin mill.

Next, 100 parts of the coarsely pulverized product obtained by the pulverization by the pin mill, 1.5 parts of sodium dodecylbenzenesulfonate as a surfactant, 1.5 parts of HITENOL EA-177 (HLB 16), 2.1 parts of dimethylaminoethanol, 2 parts of potassium carbonate, and 70 parts of deionized water were added, the temperature was increased to 115° C. in a 1 L stirring vessel, and the mixture was stirred at a stirring speed of 300 rpm for 2 hours. Thereafter, 160 parts of deionized water was continuously added dropwise thereto for 1 hour at 95° C. Then, the mixture was cooled to room temperature, whereby a dispersion of toner component particles R was obtained. The volume average particle diameter of the obtained particles measured by SALD7000 manufactured by Shimadzu Corporation was 0.1 μm.

<Preparation of Decolorizable Toner>

1.7 parts of a dispersion of decolorizable toner color-developed particles C, 15 parts of a dispersion of decolorizable toner component particles R, and 83 parts of ion exchanged water were mixed, and 5 parts of an aqueous solution of 5% aluminum sulfate was added to the resulting mixture while stirring the mixture using a homogenizer (manufactured by IKA Japan K.K.). Then, the temperature was increased to 40° C. while stirring the mixture at 800 rpm in a 1 L stirring vessel equipped with a paddle blade. After the mixture was left at 40° C. for 1 hour, 10 parts of an aqueous solution of 10% sodium polycarboxylate was added thereto. The resulting mixture was heated and then cooled, whereby a decolorizable toner dispersion liquid having a blue color was obtained.

The toner dispersion liquid was put into a filter press and washed with 100 kg of ion exchanged water. A dried toner having a water content of 0.8% was then obtained using a flash jet dryer.

As additives, 2 parts by weight of hydrophobic silica and 0.5 parts by weight of titanium oxide were adhered to surfaces of particles of the dried toner, whereby a decolorizable toner was obtained. The particle diameter was measured using Multisizer 3 manufactured by Beckman Coulter, Inc. and the 50% volume average particle diameter Dv was 7.5 μm. The volume average particle size distribution CV was 18. The circularity measured by a particle diameter-shape analyzer (FPIA) was 0.89.

<Manufacturing of Normal Yellow Toner Particles>

After mixing a colored fine particle material having the following composition, the mixture was processed with a twin-screw kneader in which the temperature was set to 120° C., and thus a kneaded product was obtained. The kneaded product was pulverized by a hammer mill to obtain a coarsely granulated mixture.

Composition of Colored Fine Particle Material

Polyester Resin (weight average molecular weight Mw=5,000, acid value=10 mgKOH/g, glass transition temperature Tg=55° C.): 86 parts by weight Yellow Pigment (first yellow 415): 7 parts by weight Ester Wax: 7 parts by weight The coarsely granulated mixture was pulverized using two turbo mills T-800 manufactured by Turbo Corporation at a rotor speed of 155 m/s and a supply rate of the coarsely pulverized product of 260 kg/hr with an entrance temperature of −20° C. and an exit temperature of 45° C. in the mechanical pulverizer, whereby a finely pulverized product containing 58.1 number % of particles having D50 of 5.5 μm and a particle diameter of 4.0 μm or less and 0.6 volume % of particles having a particle diameter of 10.1 μm or greater was obtained.

Next, using two elbow jet wind power classifiers, classification was performed at a feeding rate of 260 kg/hr, whereby pulverized yellow toner particles containing 27.9 number % of particles having a weight average diameter of 5.7 μm and a particle diameter of 4.0 μm or less and 0.1 volume % of particles having a particle diameter of 10.1 μm or greater were obtained. 2 parts by weight of hydrophobic silica and 0.5 parts by weight of titanium oxide as additives were adhered to surfaces of the obtained toner particles, whereby developable yellow toner particles were obtained.

<Manufacturing of Normal Magenta Toner Particles>

Magenta toner particles were manufactured in the same manner as in the manufacturing of the yellow toner particles, except that a magenta pigment (ECR001) was used in place of the yellow pigment.

<Manufacturing of Normal Cyan Toner Particles>

Cyan toner particles were manufactured in the same manner as in the manufacturing of the yellow toner particles, except that a cyan pigment (Pigment Blue 2) was used in place of the yellow pigment.

(Example of Image Forming Process)

The above normal toner particles of three colors (base toner particles) and the above decolorizable toner were mixed with a ferrite carrier coated with a silicone resin or the like, respectively, and were mounted as toner cartridges 102E to 102C on an image forming apparatus (MFP manufactured by Toshiba Tec Corporation, e-studio 2050*c*). The image forming apparatus performed an image forming process including: transferring the toners such that a decolorizable toner superimposes a base toner which was a normal toner as shown in FIG. 2A and FIG. 2B; and performing a fixing process at a fixing machine temperature of 70° C. The image density of the color-developed image measured was 0.5, and the fact that the image of the non-decolorizable toner was masked by the image of the decolorizable toner without being seen due to the decolorizing of the decolorizable toner was confirmed by visual observation.

(Example of Decolorizing Process)

A decolorizing process was performed by transporting the obtained color-developed image to the fixing machine set to have a fixing machine temperature of 100° C. in the image forming apparatus 1 at a paper feed speed of 100 mm/sec. The image after the decolorizing process was examined, and as a result the base image was recognized visually.

(Method of Evaluating Complete Transmission Temperature)

Regarding a sample which was prepared in the above-described example of the image forming process and in which the decolorizable toner was superimposed on an image formed with the normal toner to mask the image, a complete transmission temperature at which the decolorizable toner was decolorized and the base image formed with the normal toner could be completely seen was measured. As for the complete transmission temperature, the image (paper) fixed at a fixing temperature of 70° C. was cut into a 5-mm square and placed on a glass slide. The glass slide was covered with a cover glass to make the 5-mm square image (paper) even, and the cover glass was heated by a hotplate. The heating was performed for 10 minutes and the temperature at which the base was completely seen by visual observation was set as the complete transmission temperature.

In the case of the sample of the above-described example, the temperature at which the base image was completely seen by visual observation was 100° C., and thus the complete transmission temperature was 100° C.

As shown from the foregoing examples, when an image is formed by covering at least a part of an image of non-decolorizable toner using decolorizable toner containing a larger amount of a color material than the non-decolorizable toner, the non-decolorizable toner can be masked. In addition, it was confirmed that an image in which the non-decolorizable base image can be seen by decolorizing the decolorizable toner by performing the decolorizing process on the image can be formed.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A sheet, comprising:

a non-decolorizable material forming a first image;

a decolorizable material forming a second image superimposed over the first image;

wherein the sheet displays the first image when the decolorizable material is in a decolorized state and displays the second image when the decolorizable material is in a color-developed state.

2. The sheet according to claim 1, wherein the non-decolorizable material comprises a first color material, and the decolorizable material comprises a second color material.

3. The sheet according to claim 2, wherein density of the second color material is greater than density of the first color material.

4. The sheet according to claim 3, wherein the second image masks the first image when the decolorizable material is in a color-developed state.

5. The sheet according to claim 2, wherein the density of the second color material in the decolorizable material is equal to or greater than 3% and equal to or smaller than 30%.

6. The sheet according to claim 2, wherein the second color material comprises an electron-donating coloring agent and an electron-accepting color developing agent.

7. The sheet according to claim 6, wherein the electron-donating coloring agent comprises a leuco dye.

8. The sheet according to claim 6, wherein the second color material further comprises a binder resin.

9. The sheet according to claim 2, wherein the first color material has the same color as the second color material.

10. The sheet according to claim 2, wherein the first color material has a different color from the second color material.

11. The sheet according to claim 2, wherein the first color material has a color of cyan and the second color material has a color of blue.

12. The sheet according to claim 1, wherein the decolorizable material is capable of being decolorized when heated above a predetermined temperature.

* * * * *